US011384638B2

(12) United States Patent
Zhang et al.

(10) Patent No.: US 11,384,638 B2
(45) Date of Patent: Jul. 12, 2022

(54) APPARATUS FOR CONTROLLABLY UNFOLDING FLEXIBLE MESH FOR CONTINUOUS MINER, AND CONTINUOUS MINER

(71) Applicant: CHINA UNIVERSITY OF MINING AND TECHNOLOGY, Jiangsu (CN)

(72) Inventors: Nong Zhang, Jiangsu (CN); Zhengzheng Xie, Jiangsu (CN); Qun Wei, Jiangsu (CN); Junyao Zhou, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 114 days.

(21) Appl. No.: 17/059,219

(22) PCT Filed: Oct. 29, 2018

(86) PCT No.: PCT/CN2018/112383
§ 371 (c)(1),
(2) Date: Nov. 26, 2020

(87) PCT Pub. No.: WO2020/052014
PCT Pub. Date: Mar. 19, 2020

(65) Prior Publication Data

US 2021/0222553 A1 Jul. 22, 2021

(30) Foreign Application Priority Data

Sep. 11, 2018 (CN) ..... 201811058265.1

(51) Int. Cl.
*E21D 11/40* (2006.01)
*E21C 25/10* (2006.01)

(52) U.S. Cl.
CPC ..... *E21D 11/406* (2016.01); *E21C 25/10* (2013.01)

(58) Field of Classification Search
CPC ..... E21D 11/40; E21D 11/403; E21D 11/406
See application file for complete search history.

(56) References Cited

U.S. PATENT DOCUMENTS 5,816,750 A * 10/1998 Steffenino ..... E21D 11/406 405/291
2020/0141238 A1* 5/2020 Galler ..... E21D 11/406

FOREIGN PATENT DOCUMENTS

CA 2926445 10/2016
CN 103696788 4/2014
(Continued)

OTHER PUBLICATIONS

"International Search Report (Form PCT/ISA/210) of PCT/CN2018/112383," dated May 29, 2019, with English translation thereof, pp. 1-5.

*Primary Examiner* — Janine M Kreck
(74) *Attorney, Agent, or Firm* — JCIP Global Inc.

(57) ABSTRACT

An apparatus for controllably unfolding a flexible mesh for a continuous miner includes a mesh roll storage rack, a height adjustment post, a mesh rolling shaft and a flexible mesh. The flexible mesh includes a mesh roll and an unfolded mesh. The mesh roll and the unfolded mesh are an integrated structure. The mesh roll is located on the mesh roll storage rack. The unfolded mesh is clamped on the mesh rolling shaft, and is pressed on a cut un-supported tunnel roof via a roof bolt. The mesh rolling shaft is rotatably connected to a top portion of the height adjustment post. The mesh roll storage rack and the height adjustment post are both mounted on the continuous miner. The mesh rolling shaft is located at a back end of the mesh roll storage rack. A limit mechanism and a damping mechanism are disposed on the mesh rolling shaft.

10 Claims, 10 Drawing Sheets

(56) References Cited

FOREIGN PATENT DOCUMENTS

| | | |
|---|---|---|
| CN | 204344122 | 5/2015 |
| CN | 106223947 | 12/2016 |
| CN | 106401623 | 2/2017 |
| CN | 108868758 | 11/2018 |
| SU | 829953 | 5/1981 |

* cited by examiner

APPARATUS FOR CONTROLLABLY UNFOLDING FLEXIBLE MESH FOR CONTINUOUS MINER, AND CONTINUOUS MINER

CROSS-REFERENCE TO RELATED APPLICATION

This application is a 371 of international application of PCT application serial no. PCT/CN2018/112383, filed on Oct. 29, 2018, which claims the priority benefit of China application no. 201811058265.1, filed on Sep. 11, 2018. The entirety of each of the above mentioned patent applications is hereby incorporated by reference herein and made a part of this specification.

BACKGROUND

Technical Field

The present invention relates to a continuous miner, more particularly to an apparatus for controllably unfolding a flexible mesh for a continuous miner and a continuous miner, and is suitable for driving a tunnel having a simple geologic condition, a small coal seam inclination angle, and a good roof self-stability.

Description of Related Art

In underground coal mining in China, with the constant improvement of mechanization, automation and intelligence levels, the fully-mechanized mining efficiency is gradually improved. In contrast, under the influence of the current matching technology, the tunneling speed is improved slowly, thereby causing the problem of imbalance between coal production and mining. Bolt support has the advantages of safety, flexibility, high efficiency and the like, and is a support method widely used in a coal mine tunnel in China. Mesh is a common surface protection member in bolt support, and the effects thereof are to maintain a rock mass between bolts to be complete, confine crushed rock fragments in situ, and maintain a three-dimensional stress state of a deep surrounding rock. In recent years, a flexible mesh made from a macromolecule material and used for underground coal mine bolt support is provided. The flexible mesh has the advantages of high strength, large bearing capacity, large single piece area and the like. However, the mesh is difficult to realize mechanical construction all the time, but is mostly completed by manpower. The high labor strength and low working efficiency are the factors seriously restricting tunneling mechanization, automation and intelligence. In addition, a worker generally needs to get close to an exposed rock mass during mesh construction. Therefore, the safety is poor.

SUMMARY

In order to solve the problems of high labor strength, low working efficiency, and poor safety in bolt support construction because mesh construction must be completed by manpower in bolt support, the present invention provides an apparatus for controllably unfolding a flexible mesh for a continuous miner and a continuous miner, improves the mesh unfolding mechanization level, and is suitable for the coal mines having a good roof and a large face-to-gob distance in west of China.

To achieve the above technical object, one technical solution adopted by the present invention is as follows.

An apparatus for controllably unfolding a flexible mesh for a continuous miner, including a mesh roll storage rack, a height adjustment post, a mesh rolling shaft and a flexible mesh. The flexible mesh consists of a mesh roll and an unfolded mesh. The mesh roll and the unfolded mesh are an integrated structure. The mesh roll is located on the mesh roll storage rack. The unfolded mesh is clamped on the mesh rolling shaft, and is pressed on a cut and un-supported tunnel roof via a roof bolt. The mesh rolling shaft is rotatably connected to a top portion of the height adjustment post. The mesh roll storage rack and the height adjustment post are both mounted on the continuous miner. The mesh rolling shaft is located at a back end of the mesh roll storage rack.

A plurality of mesh hanging disks are fixed on an outer surface of the mesh rolling shaft. The unfolded mesh is clamped on the mesh hanging disks. A limit mechanism and a damping mechanism are disposed on the mesh rolling shaft. The limit mechanism includes a limit oil cylinder, a limit slide bar and a limit gear. A limit cylinder body of the limit oil cylinder is fixedly connected to the height adjustment post. A limit piston rod of the limit oil cylinder is hinged to a bottom portion of the limit slide bar. The limit gear is fixed on the mesh rolling shaft, and is located above the limit slide bar. The limit oil cylinder is used to drive the limit slide bar to engage with a tooth space of the limit gear fixed to the mesh rolling shaft, so as to limit the mesh rolling shaft. The damping mechanism includes a damping slide bar, a damping spring, a damping slide bar base, a damping disk cover and an adjustment screw plug. The damping slide bar base is internally provided with a penetrative cavity extending in a length direction thereof. The adjustment screw plug is threadedly connected to a tail of the cavity in the damping slide bar base. A bottom end of the damping slide bar extends into the cavity from a top portion of the damping slide bar base. The damping spring is located in the cavity. A top portion of the damping spring is in contact with the bottom end of the damping slide bar, and a bottom portion of the damping spring is in contact with a top portion of the adjustment screw plug. The damping disk cover is fixed on the mesh rolling shaft. An outer surface of the damping disk cover is provided with a plurality of arc-shaped notches distributed in a circumferential direction thereof, and the arc-shaped notches are located above the damping slide bar. The damping spring is used to press the damping slide bar into the arc-shaped notches of the damping disk cover, so as to damp the mesh rolling shaft.

As a further improved technical solution of the present invention, the mesh rolling shaft includes an intermediate portion, a first side portion and a second side portion. The uniformly distributed mesh hanging disks are fixed on outer surfaces of the intermediate portion, the first side portion and the second side portion. Two ends of the intermediate portion are both provided with a first connecting shaft and a second connecting shaft which are connected to each other. The intermediate portion, the first connecting shaft and the second connecting shaft are an integrated structure, and diameters thereof progressively decrease. The intermediate portion, the first connecting shaft and the second connecting shaft are sequentially connected. One end portion of the first side portion and one end portion of the second side portion are both provided with a shaft hole cooperatively connected to the second connecting shaft. The second connecting shaft at one end of the intermediate portion extends into the shaft hole of the first side portion, and the second connecting shaft is connected to the shaft hole of the first side portion via a first flat key. The second connecting shaft at the other end of the intermediate portion extends into the shaft hole of the second side portion, and the second connecting shaft is connected to the shaft hole of the second side portion via a first flat key.

As a further improved technical solution of the present invention, a number of the height adjustment post is two. The top portion of one of the height adjustment posts is rotatably connected to the second connecting shaft at one end of the intermediate portion via a rolling bearing which is located at one end of the second connecting shaft connected to the first connecting shaft. The top portion of the other one of the height adjustment posts is rotatably connected to the second connecting shaft at the other end of the intermediate portion via a rolling bearing which is located at one end of the second connecting shaft connected to the first connecting shaft. An outer ring of each of the rolling bearings is in interference connection with the top portion of a respective one of the height adjustment posts. An inner ring of the rolling bearing is in interference connection with the second connecting shaft.

As a further improved technical solution of the present invention, a number of the limit mechanism and a number of the damping mechanism are both two. The limit gear in one of the limit mechanisms is fixedly connected to one end surface of the intermediate portion via a screw, and the limit gear is sleeved on the first connecting shaft connected to the end surface. The limit gear in the other one of the limit mechanisms is fixedly connected to the other end surface of the intermediate portion via a screw, and the limit gear is sleeved on the first connecting shaft connected to the end surface. The damping disk cover in one damping mechanism is fixedly connected, via a screw, to an end surface of the first side portion provided with the shaft hole, and the damping disk cover is sleeved on the second connecting shaft connected to the shaft hole. The damping disk cover in the other one of the damping mechanisms is fixedly connected, via a screw, to an end surface of the second side portion provided with the shaft hole, and the damping disk cover is sleeved on the second connecting shaft connected to the shaft hole.

As a further improved technical solution of the present invention, an annular clamping groove is respectively disposed on outer surfaces of the second connecting shafts at the two ends of the intermediate portion. Two semi-circular clamping keys are clamped in the annular clamping groove, and the two semi-circular clamping keys are fitted together to form a circular clamping key. An end surface of the semi-circular clamping key on the outer surface of the second connecting shaft at one end of the intermediate portion is in close contact with one end surface of the first side portion. An end surface of the semi-circular clamping key on the outer surface of the second connecting shaft at the other end of the intermediate portion is in close contact with one end surface of the second side portion. The damping disk cover includes a damping portion and a disk cover portion. The damping portion and the disk cover portion are connected to each other, and are an integrated structure. An outer surface of the damping portion is provided with a plurality of arc-shaped notches distributed in a circumferential direction thereof. A plurality of fixing holes are disposed on an outer surface of the disk cover portion. A circular groove for placing the semi-circular clamping keys is disposed on an inner wall of the disk cover portion. The disk cover portion in one damping disk cover is fixedly connected to one end surface of the first side portion via the fixing holes, and the groove on the inner wall of the disk cover portion and one annular clamping groove are in a same vertical direction. The disk cover portion in the other damping disk cover is fixedly connected to one end surface of the second side portion via the fixing holes, and the groove on the inner wall of the disk cover portion and the other annular clamping groove are in a same vertical direction. The semi-circular clamping key is located between the annular clamping groove and the groove on the inner wall of the disk cover portion.

As a further improved technical solution of the present invention, each of the limit mechanisms further includes a guide base. The guide base is located above the limit oil cylinder. The guide base is fixedly connected to a respective one of the height adjustment posts. The guide base is internally provided with a penetrative strip-shaped chamber extending in a length direction thereof. The limit slide bar penetrates through the strip-shaped chamber in the guide base. A first key groove is disposed on an inner wall of the strip-shaped chamber. A second key groove matched with the first key groove is disposed on an outer surface of the limit slide bar. A second flat key is fixed in the second key groove, and the second flat key is located in the first key groove, and the second flat key is slidably connected to the first key groove.

As a further improved technical solution of the present invention, an outer surface of the mesh hanging disk is provided with a plurality of inclined mesh hanging grooves distributed in a circumferential direction thereof. The unfolded mesh is clamped in the mesh hanging grooves. The mesh hanging disk is fixedly connected to the mesh rolling shaft by welding. The mesh roll storage rack includes a rack body and a plurality of support rollers arranged in an arc shape along the rack body. The support roller includes a support roller shaft and a support roller sleeve. Two ends of the support roller shaft are fixedly connected to the rack body. The support roller sleeve is sleeved outside the support roller shaft, and is rotatably connected to the support roller shaft. The mesh roll is located on the support roller. The rack body is mounted on the continuous miner.

As a further improved technical solution of the present invention, the height adjustment post includes a square inner sleeve, a square outer sleeve and a height adjustment oil cylinder. A bottom portion of the square outer sleeve is fixed on the continuous miner via a bolt. One end of the square inner sleeve is embedded in the square outer sleeve, and the square inner sleeve is slidably connected to the square outer sleeve. A bottom portion of a cylinder body of the height adjustment oil cylinder is hinged to the square outer sleeve via a lower pin shaft. A top portion of the cylinder body of the height adjustment oil cylinder extends into the square inner sleeve, and a piston rod of the height adjustment oil cylinder is hinged to the square inner sleeve via an upper pin shaft. A top portion of the square inner sleeve is rotatably connected to the mesh rolling shaft. The limit oil cylinder, the guide base and the damping slide bar base are all fixed on the square inner sleeve. The height adjustment oil cylinder is a double-acting cylinder. A lower oil port of the height adjustment oil cylinder extends out from a hole at the bottom portion of the square outer sleeve via a pipe, and is in communication with pressure oil. An upper oil port of the height adjustment oil cylinder sequentially extends out from the holes at a bottom portion of the square inner sleeve and at the bottom portion of the square outer sleeve via a pipe, and is in communication with pressure oil.

As a further improved technical solution of the present invention, the limit oil cylinder is a single-acting cylinder. An oil inlet of the limit oil cylinder is in communication with the pressure oil via a travel reversing valve on the continuous miner, so as to link the limit oil cylinder to an oilway of a travel mechanism on the continuous miner.

To achieve the above technical object, another technical solution adopted by the present invention is as follows.

A continuous miner includes the apparatus for controllably unfolding a flexible mesh for a continuous miner.

The beneficial effects of the present invention are as follows. The present invention controllably unfolds the flexible mesh by embedding mesh wires of the flexible mesh wound on the mesh rolling shaft in the mesh hanging groove of the mesh hanging disk, reduces manual operation, and has a high working efficiency and high safety. The limit mechanism can limit and release the mesh rolling shaft. When the mesh rolling shaft is limited, the mesh rolling shaft cannot rotate, ensuring that the flexible mesh cannot be unfolded. When the mesh rolling shaft is released, the mesh rolling shaft can rotate under an acting force of the flexible mesh, so as to release the flexible mesh. The action of the limit mechanism can be linked to an oilway of a hydraulic travel mechanism of the continuous miner, and can also be driven by a separately disposed hydraulic system. The present invention further provides a resistance adjustable damping mechanism for preventing the mesh rolling shaft from over-rotating to excessively unfold the mesh. The mesh roll storage rack is provided with a plurality of support rollers, facilitating the unfolding of the mesh roll under traction. The height adjustment post can adjust the height of the mesh rolling shaft under the drive of the hydraulic system, so as to adapt to different tunnel heights. The controllable unfolding apparatus according to the present invention can controllably unfold the flexible mesh under the traction of the continuous miner, can create conditions for performing a bolt support work in back of the continuous miner, and can implement cut and support works in parallel, thereby improving tunneling efficiency.

DESCRIPTION OF THE EMBODIMENTS

Specific embodiments of the present invention will be further described hereafter according to FIG. 1 to FIG. 15.

In order to solve the problems of high labor strength, low working efficiency, and poor safety in bolt support construction because mesh construction must be completed by manpower in bolt support, the present invention provides an apparatus for controllably unfolding a flexible mesh for a continuous miner and a continuous miner, which improves the mesh unfolding mechanization level.

Figure 1:
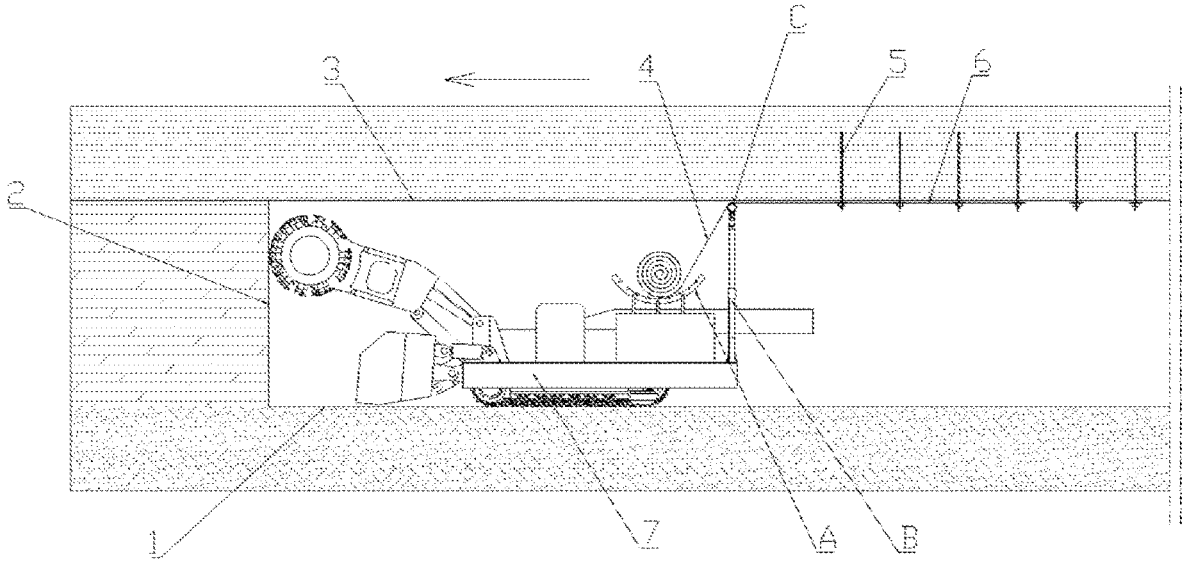
FIG. 1 is a side view of a continuous miner in an operating state during tunneling.
Figure 2:
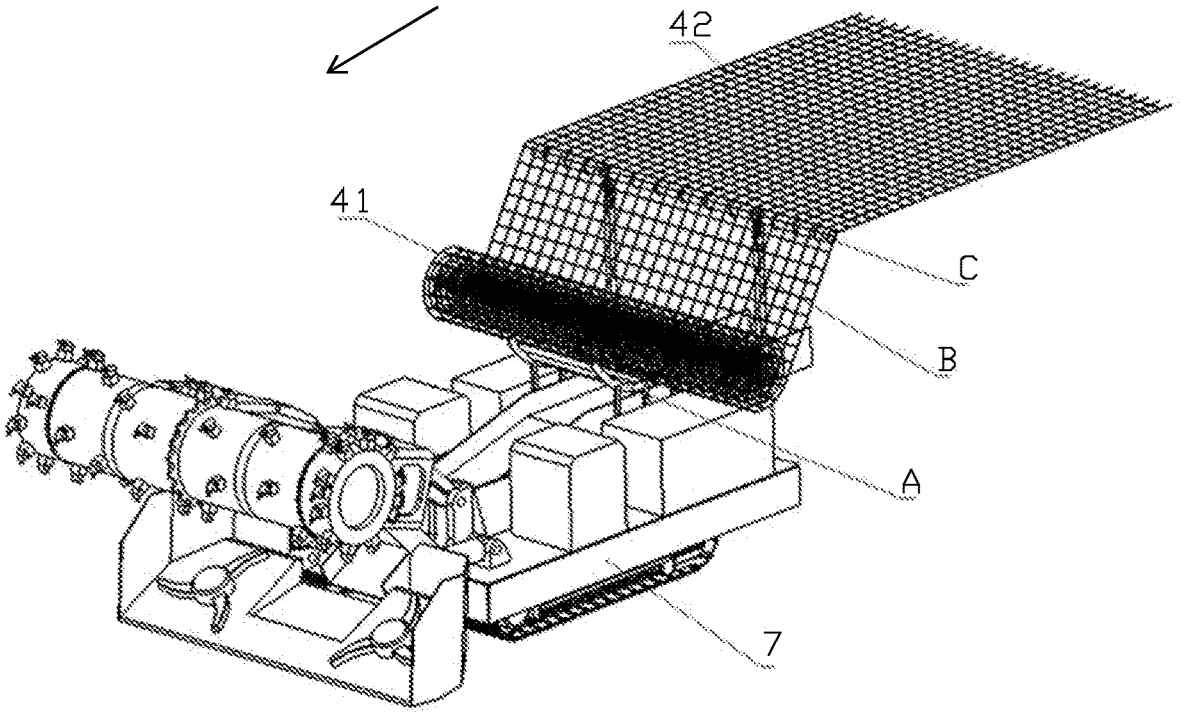
FIG. 2 is an oblique view of the continuous miner.

FIG. 1 is a side view of a continuous miner in an operating state during tunneling. With reference to FIG. 1, the reference signs include tunnel floor 1, tunnel working surface 2, cut and unsupported tunnel roof 3, roof bolt 5, supported tunnel roof 6, continuous miner 7, and flexible mesh 4. The embodiment provides a continuous miner including the apparatus for controllably unfolding a flexible mesh for a continuous miner 7. The continuous miner 7 can controllably unfold the flexible mesh under the traction of the continuous miner 7, can create conditions for performing a bolt support work in back of the continuous miner 7, and can implement cut and support works in parallel, thereby improving tunneling efficiency. With reference to FIG. 2, the flexible mesh 4 on the continuous miner 7 includes a mesh roll 41 and an unfolded mesh 42. The mesh roll 41 and the unfolded mesh 42 are integrally connected as one piece. The unfolded mesh 42 at the supported tunnel roof 6 is already pressed on the tunnel roof by the roof bolt 5 to play a support role. The unfolded mesh 42 in a region to be supported is tight, and is pending to be supported by the roof bolt 5. Therefore, when the unfolded mesh 42 is not pressed by the roof bolt 5, the unfolded mesh does not have the support effect. However, the roof bolt support cannot be constructed until the mesh is appropriately unfolded.

Figure 4:
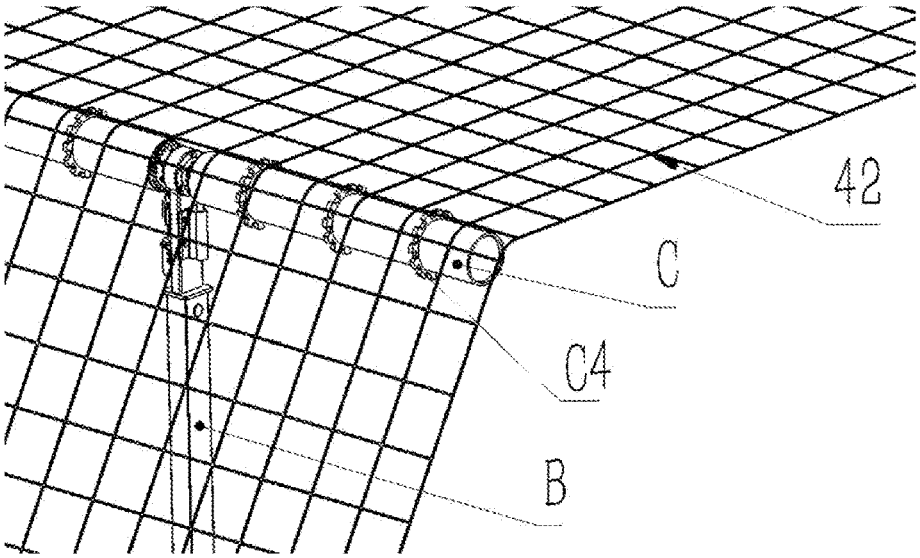
FIG. 4 is a structural schematic view of a flexible mesh wound on a mesh rolling shaft.

With reference to FIG. 1, the embodiment provides an apparatus for controllably unfolding a flexible mesh for a continuous miner, including a mesh roll storage rack A, a height adjustment post B, a mesh rolling shaft C and a flexible mesh 4. With reference to FIG. 2, the flexible mesh 4 includes a mesh roll 41 and an unfolded mesh 42. The mesh roll 41 and the unfolded mesh 42 are an integrated structure. The mesh roll 41 is located on the mesh roll storage rack A. With reference to FIG. 4, the unfolded mesh 42 is clamped on the mesh rolling shaft C, and is pressed on the cut and un-supported tunnel roof 3 via the roof bolt 5, so as to form the supported tunnel roof 6. The mesh rolling shaft C is rotatably connected to a top portion of the height adjustment post B. The mesh roll storage rack A and the height adjustment post B are both mounted on the continuous miner 7. The mesh rolling shaft C is located at a back end of the mesh roll storage rack A.

Figure 3:
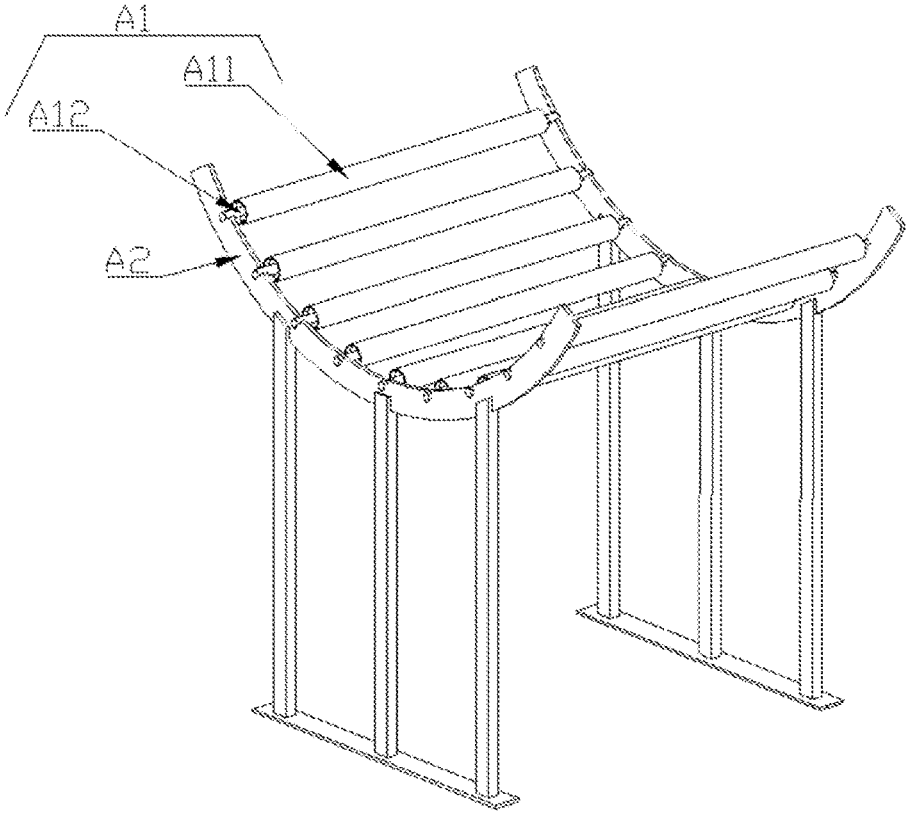
FIG. 3 is a structural schematic view of a mesh roll storage rack.

With reference to FIG. 3, the mesh roll storage rack A includes a rack body A2 and a plurality of support rollers A1 arranged in an arc shape along the rack body A2. The support roller A1 includes a support roller shaft A12 and a support roller sleeve A11. Two ends of the support roller shaft A12 are fixedly connected to the rack body A2. The support roller sleeve A11 is sleeved outside the support roller shaft A12, and is rotatably connected to the support roller shaft A12. The mesh roll 41 is located on the support roller sleeve A11 of the support roller A1. The rack body A2 is mounted on the continuous miner 7. The support roller sleeve A11 of the support roller A1 is used to bear the mesh roll 41 and ensure that the unfolding resistance of the mesh roll 41 decreases during unfolding. The support roller sleeve A11 of the support roller A1 can freely rotate. In addition, in the embodiment, a rotary shaft can be disposed in the middle of the mesh roll 41. The two ends of the rotary shaft are connected to the rack body A2 via a bracket. The rotary shaft can be rotatably connected to the bracket or not, which does not influence the other functions of the present invention. The mesh roll 41 is directly placed on the mesh roll storage rack A with no connection therebetween. The mesh roll 41 is in contact with the support roller A1. When the back unfolded mesh 42 drives the mesh roll 41 to unfold, the mesh roll 41 can freely rotate on the support roller A1, such that the mesh roll 41 can be passively unfolded. The net roll 41 and the unfolded net 42 are integrally connected as one piece. The unfolded mesh 42 at the supported tunnel roof 6 is already pressed on the roof by the bolt to play a support role. The unfolded mesh 42 in a region to be supported is tight, and is pending to be supported by the bolt.

Figure 5:
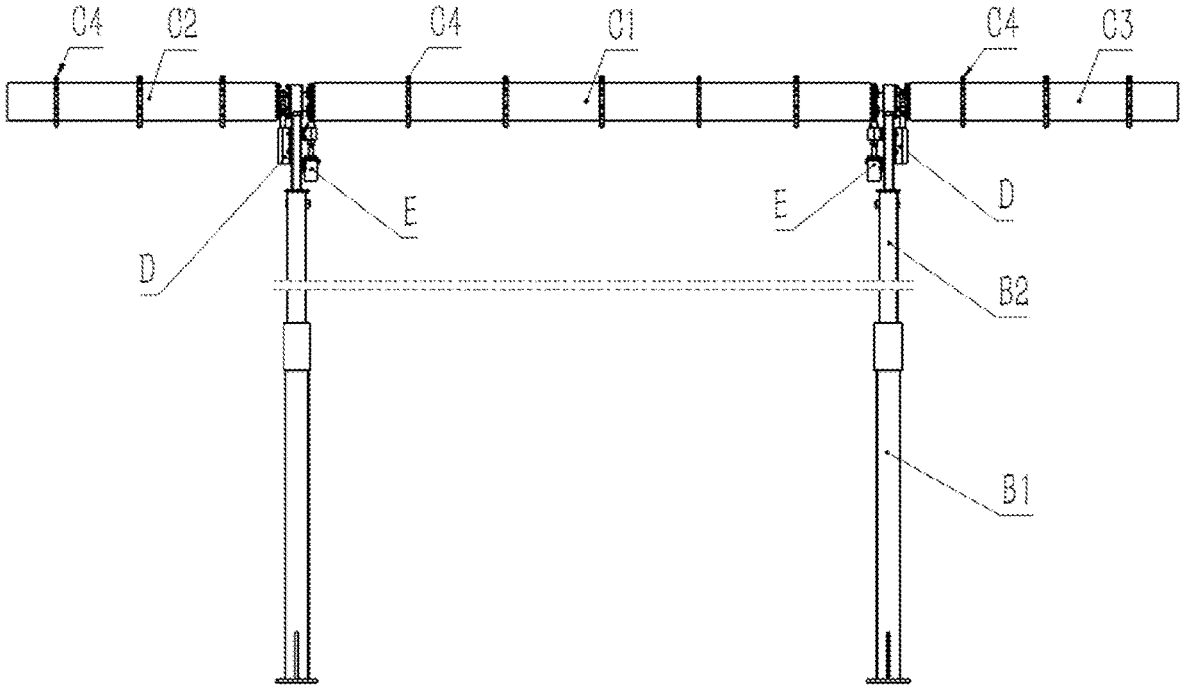
FIG. 5 is a sectional view of a part of the mesh rolling shaft.
Figure 6:
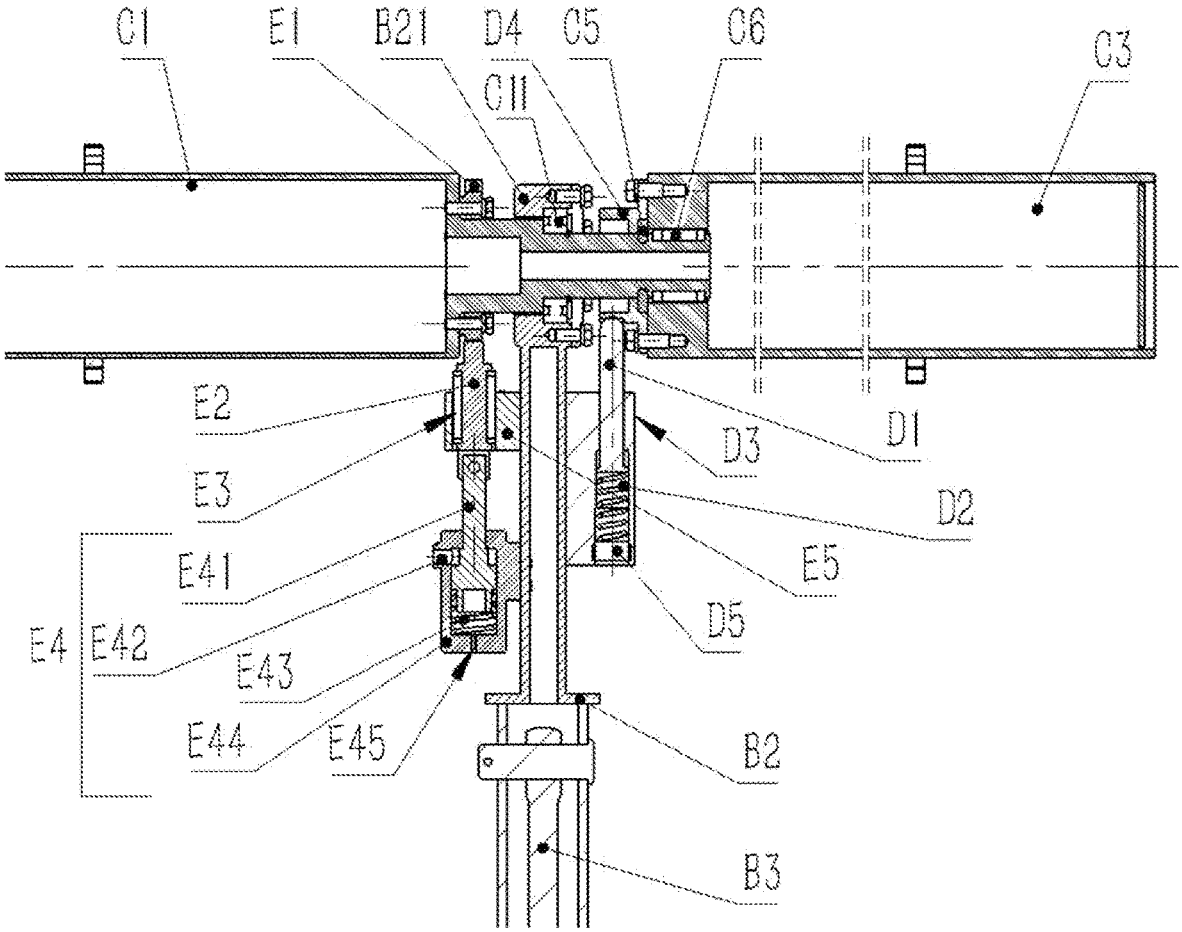
FIG. 6 is a sectional view of a connection position between an intermediate portion of the mesh rolling shaft and a second side portion.
Figure 12:
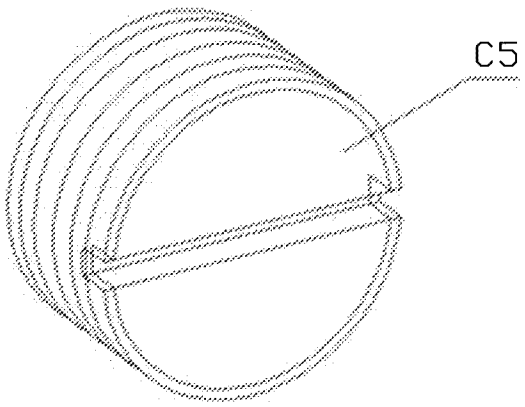
FIG. 12 is a structural schematic view of an adjustment screw plug.

With reference to FIG. 4, a plurality of mesh hanging disks C4 are fixed on an outer surface of the mesh rolling shaft C. The unfolded mesh 42 is clamped on the mesh hanging disks C4. With reference to FIG. 5, two limit mechanism E and two damping mechanism D are disposed on the mesh rolling shaft C. With reference to FIG. 6, each of the limit mechanisms E includes a limit oil cylinder E4, a limit slide bar E2 and a limit gear E1. A limit cylinder body E44 of the limit oil cylinder E4 is fixedly connected to the height adjustment post B. A limit piston rod E41 of the limit oil cylinder E4 is hinged to a bottom portion of the limit slide bar E2. The limit gear E1 is fixed on the mesh rolling shaft C, and is located above the limit slide bar E2. The limit oil cylinder E4 is used to drive the limit slide bar E2 to engage with a tooth space of the limit gear E1 fixed to the mesh rolling shaft C, so as to limit the mesh rolling shaft C. When the limit slide bar E2 is drawn out, the limitation is released, and the mesh rolling shaft C can roll. Each of the damping mechanism D includes a damping slide bar D1, a damping spring D2, a damping slide bar base D3, a damping disk cover D4 and an adjustment screw plug D5. The damping slide bar base D3 is internally provided with a penetrative cavity extending in a length direction thereof. The cavity is divided into an upper cavity and a lower cavity. The cross sectional area of the upper cavity is less than the cross sectional area of the lower cavity. The adjustment screw plug D5, the damping spring D2, and a bottom end of the damping slide bar D1 are all located in the lower cavity. The bottom end of the damping slide bar D1 is in an inverted T shape which can prevent the bottom end of the damping slide bar D1 from sliding into the upper cavity. The adjustment screw plug D5 is threadedly connected to a tail of the cavity in the damping slide bar base D3. A bottom end of the damping slide bar D1 extends into the cavity from a top portion of the damping slide bar base D3. The damping spring D2 is located in the cavity. A top portion of the damping spring D2 is in contact with the bottom end of the damping slide bar D1, and a bottom portion of the damping spring D2 is in contact with a top portion of the adjustment screw plug D5. The damping disk cover D4 is fixed on the mesh rolling shaft C. An outer surface of the damping disk cover D4 is provided with a plurality of arc-shaped notches D41 distributed in a circumferential direction thereof, and the arc-shaped notches D41 are located above the damping slide bar D1. The adjustment screw plug D5 is tightened. The damping spring D2 is used to press the damping slide bar D1 into the arc-shaped notches D41 of the damping disk cover D4, so as to damp the mesh rolling shaft C. The structure of the adjustment screw plug D5 is as shown in FIG. 12.

With reference to FIG. 6, the damping slide bar D1 can slide in the damping slide bar base D3 along the cavity. The damping spring D2 is in contact with the bottom end of the damping slide bar D1. The adjustment screw plug D5 is threadedly connected to the damping slide bar base D3. By rotating the adjustment screw plug D5, the adjustment screw plug D5 is screwed in along the damping slide bar base D3 via the screwed connection, squeezes and compresses the damping spring D2, and applies an outward thrust force to the damping slide bar D1, such that an end head of the damping slide bar D1 enters the arc-shaped notch D41 of the damping disk cover D4 to clamp the damping disk cover D4. By adjusting the tightness of the adjustment screw plug D5, the damping slide bar D1 can apply different damping forces to the damping disk cover D4. The damping disk cover D4 is connected to the mesh rolling shaft C via a flange hole (namely the fixing hole D44) and a bolt.

Figure 10:
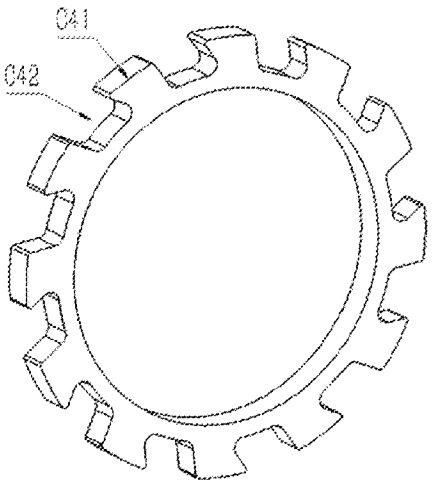
FIG. 10 is a structural schematic view of a mesh hanging disk.

With reference to FIG. 10, an outer surface of the mesh hanging disk C4 is provided with a plurality of inclined mesh hanging grooves C42 distributed in a circumferential direction thereof. A disk gear C41 is formed between every two adjacent mesh hanging grooves C42. The unfolded mesh 42 is clamped in the mesh hanging grooves C42. The mesh hanging disk C4 is fixedly connected to the mesh rolling shaft C by means of welding. In the embodiment, the mesh wires of the flexible mesh 4 wound on the mesh rolling shaft C are embedded in the mesh hanging groove C42 of the mesh hanging disk C4. The limit mechanism E can limit and release the mesh rolling shaft C. When limited, the mesh rolling shaft C cannot move, so as to ensure that the flexible mesh cannot be unfolded. When released, the mesh rolling shaft C can rotate under an acting force of the mesh, so as to release the mesh. The action of the limit mechanism E can be linked to an oilway of a hydraulic travel mechanism of the continuous miner, and can also be driven by a separately disposed hydraulic system. A resistance adjustable damping mechanism D is provided to prevent the mesh rolling shaft C from over-rotating to excessively unfold the mesh. The mesh roll storage rack A is provided with a plurality of support rollers A1, facilitating the unfolding of the mesh roll 41 under traction. The height adjustment post B can extend and retract under the drive of the hydraulic system to adjust the height of the mesh rolling shaft C, so as to adapt to different tunnel heights. The apparatus for controllably unfolding a flexible mesh for a continuous miner according to the present invention can controllably unfold the flexible mesh under the traction of the continuous miner, can create conditions for performing a bolt support work in back of the continuous miner, and can implement cut and support works in parallel, thereby improving tunneling efficiency.

Figure 7:
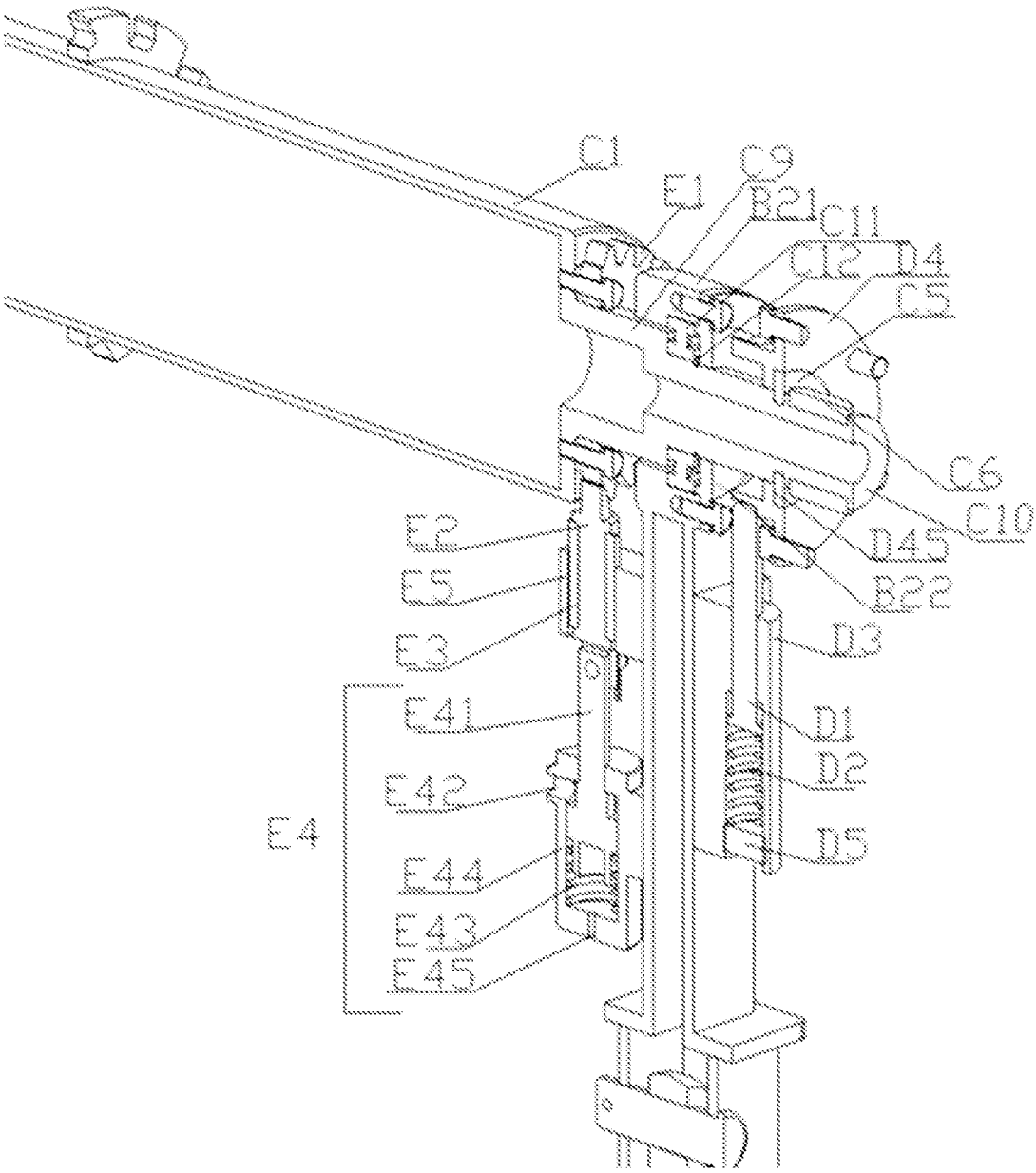
FIG. 7 is a sectional view of one end of the intermediate portion of the mesh rolling shaft.
Figure 8:
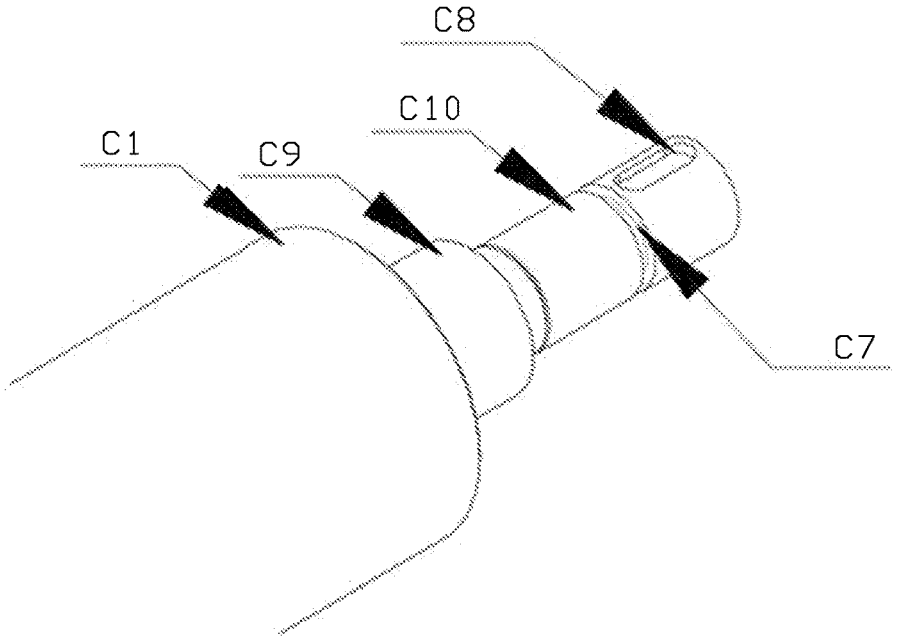
FIG. 8 is an external view of one end of the intermediate portion of the mesh rolling shaft.

With reference to FIG. 5, the mesh rolling shaft C includes an intermediate portion C1, a first side portion C2 and a second side portion C3. The uniformly distributed mesh hanging disks C4 are fixed on outer surfaces of the intermediate portion C1, the first side portion C2 and the second side portion C3. With reference to FIGS. 7 and 8, the two ends of the intermediate portion C1 are both provided with a first connecting shaft C9 and a second connecting shaft C10 which are connected to each other. The intermediate portion C1, the first connecting shaft C9 and the second connecting shaft C10 are an integrated structure, and the diameters thereof progressively decrease. The intermediate portion C1, the first connecting shaft C9 and the second connecting shaft C10 are sequentially connected. With reference to FIG. 6, one end portion of the first side portion C2 and one end portion of the second side portion C3 are both provided with a shaft hole cooperatively connected to the second connecting shaft C10. The second connecting shaft C10 at one end of the intermediate portion C1 extends into the shaft hole of the first side portion C2, and the second connecting shaft C10 is connected to the shaft hole of the first side portion C2 via a first flat key C6. By the same token, the second connecting shaft C10 at the other one end of the intermediate portion C1 extends into the shaft hole of the second side portion C3, and the second connecting shaft C10 is connected to the shaft hole of the second side portion C3 via a first flat key C6. The first flat key C6 is located in a third key groove C8 of the second connecting shaft C10 as shown in FIG. 8.

With reference to FIG. 5-7, a number of the height adjustment post B is two. The top portion of one of the height adjustment posts B is rotatably connected to the second connecting shaft C10 at one end of the intermediate portion C1 via a rolling bearing C11, and the rolling bearing C11 is located at one end of the second connecting shaft C10 connected to the first connecting shaft C9. The top portion of the other one of the height adjustment posts B is rotatably connected to the second connecting shaft C10 at the other end of the intermediate portion C1 via a rolling bearing C11, and the rolling bearing C11 is located at one end of the second connecting shaft C10 connected to the first connecting shaft C9. With reference to FIG. 7, an inner ring of the rolling bearing C11 is in interference connection with the second connecting shaft C10. An outer wall of the rolling bearing C11 is fixedly connected to the top portion of a respective one of the height adjustment posts B. The top portion of each of the height adjustment posts B is an annular structure B21. The annular structure B21 is sleeved on an outer ring of the rolling bearing C11, and closely presses against (or in interference connection with) the outer ring of the rolling bearing C11. One end surface of the inner ring of the rolling bearing C11 is in close contact with an end surface of the first connecting shaft C9. The other end surface of the inner ring of the rolling bearing C11 is in close contact with a circlip for shaft C12. The circlip for shaft C12 is fixed on an outer surface of the second connecting shaft C10, and can prevent the rolling bearing C11 from sliding out of the second connecting shaft C10. In addition, the annular structure B21 is further connected to an annular cover plate B22 via a screw. A boss at an end surface of the annular cover plate B22 is in close contact with one end surface of the outer ring of the rolling bearing C11. An inner surface of the annular structure B21 is in close contact with the other end surface of the outer ring of the rolling bearing C11, and can also prevent the rolling bearing C11 from sliding out of the second connecting shaft C10.

The mesh rolling shaft C is connected to the height adjustment post B via the mesh rolling shaft C11 with no motive force therebetween. The unfolded mesh 42 is fixed to the roof. When the continuous miner travels, the mesh roll 41 travels with the continuous miner under the action of traction, and is passively unfolded.

With reference to FIG. 5, a number of the limit mechanism E and a number of the damping mechanism D are both two. The limit gear E1 in one limit mechanism E is fixedly connected to one end surface of the intermediate portion C1 via a screw, and the limit gear E1 is sleeved on the first connecting shaft C9 connected to the end surface. The limit gear E1 in the other limit mechanism E is fixedly connected to the other end surface of the intermediate portion C1 via a screw, and the limit gear E1 is sleeved on the first connecting shaft C9 connected to the end surface. The damping disk cover D4 in one damping mechanism D is fixedly connected, via a screw, to an end surface of the first side portion C2 provided with the shaft hole, and the damping disk cover D4 is sleeved on the second connecting shaft C10 connected to the shaft hole. The damping disk cover D4 in the other damping mechanism D is fixedly connected, via a screw, to an end surface of the second side portion C3 provided with the shaft hole, and the damping disk cover D4 is sleeved on the second connecting shaft C10 connected to the shaft hole.

Figure 11:
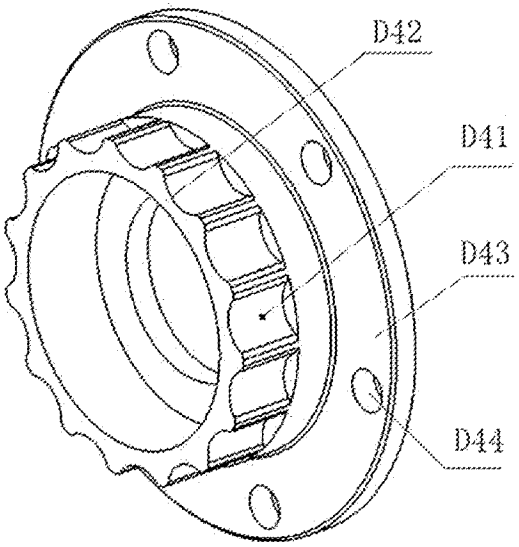
FIG. 11 is a structural schematic view of a damping disk cover.

With reference to FIG. 8, an annular clamping groove C7 is respectively disposed on the outer surfaces of the second connecting shafts C10 at the two ends of the intermediate portion C1. Two semi-circular clamping keys C5 (as shown in FIG. 7) are clamped in the annular clamping groove C7, and the two semi-circular clamping keys C5 are fitted together to form a circular clamping key. An end surface of the semi-circular clamping key C5 on the outer surface of the second connecting shaft C10 at one end of the intermediate portion C1 is in close contact with one end surface of the first side portion C2. An end surface of the semi-circular clamping key C5 on the outer surface of the second connecting shaft C10 at the other end of the intermediate portion C1 is in close contact with one end surface of the second side portion C3. With reference to FIG. 11, the damping disk cover D4 includes a damping portion D42 and a disk cover portion D43. The damping portion D42 and the disk cover portion D43 are connected to each other, and are an integrated structure. An outer surface of the damping portion D42 is provided with a plurality of arc-shaped notches D41 distributed in the circumferential direction thereof. A plurality of fixing holes D44 are disposed on an outer surface of the disk cover portion D43. A circular groove D45 (as shown in FIG. 7) for placing the semi-circular clamping keys C5 is disposed on an inner wall of the disk cover portion D43. The disk cover portion D43 in one damping disk cover D4 is fixedly connected to one end surface of the first side portion C2 via the fixing holes D44, and the groove D45 on the inner wall of the disk cover portion D43 and one annular clamping groove C7 are in the same vertical direction. The disk cover portion D43 in the other damping disk cover D4 is fixedly connected to one end surface of the second side portion C3 via the fixing holes D44, and the groove D45 on the inner wall of the disk cover portion D43 and the other annular clamping groove C7 are in the same vertical direction. The semi-circular clamping key C5 is located between the annular clamping groove C7 and the groove D45 on the inner wall of the disk cover portion D43.

With reference to FIG. 7, totally two semi-circular clamping keys C5 are disposed at each end of the intermediate portion C1, and are clamped in the annular clamping groove C7 of the intermediate portion C1 to form a complete annular structure. The effects thereof are to axially position the intermediate portion C1 and the first side portion C2, and axially position the intermediate portion C1 and the second side portion C3. Two first flat keys C6 are also disposed at each end, and are mounted in the third key groove C8 of the intermediate portion C1, so as to position the intermediate portion C1 and the first side portion C2 in a circumferential direction. The connection between the intermediate portion C1 and the second side portion C3 is the same as above. With the above method, the intermediate portion C1 and the first side portion C2 as well as the second side portion C3 are axially and circumferentially positioned.

Figure 9:
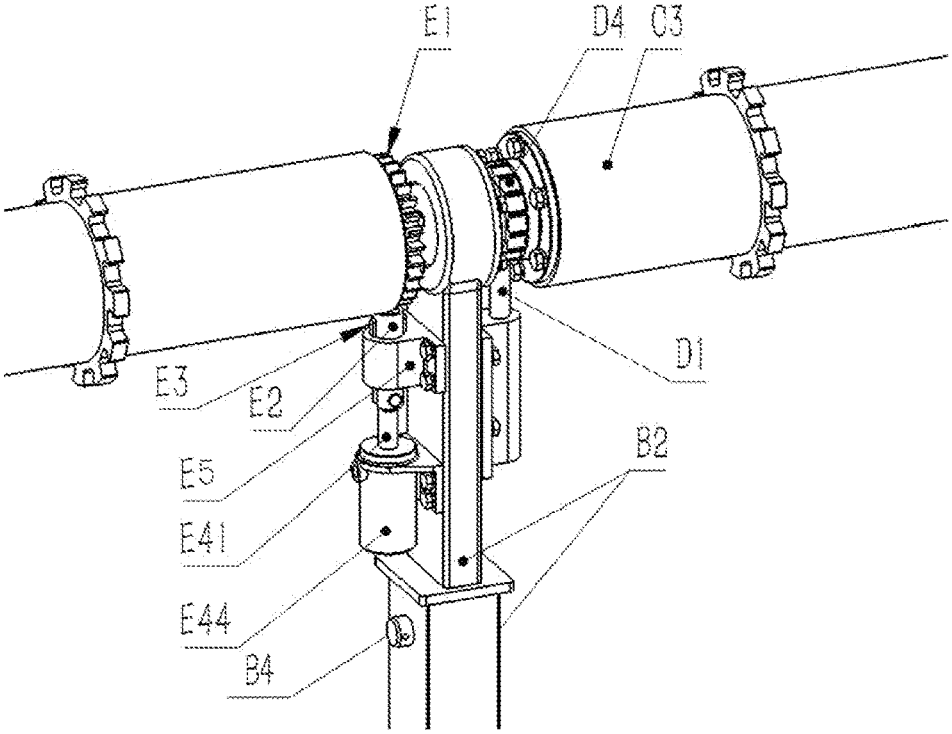
FIG. 9 is an external view of the connection position between the intermediate portion of the mesh rolling shaft and the second side portion.

With reference to FIGS. 6, 7 and 9, the limit mechanism E further includes a guide base E5. The guide base E5 is located above the limit oil cylinder E4. The guide base E5 is fixedly connected to the height adjustment post B. The guide base E5 is internally provided with a penetrative strip-shaped chamber extending in a length direction thereof. The limit slide bar E2 penetrates through the strip-shaped chamber in the guide base E5. A first key groove is disposed on an inner wall of the strip-shaped chamber. A second key groove matched with the first key groove is disposed on an outer surface of the limit slide bar E2. A second flat key E3 is fixed in the second key groove, and the second flat key E3 is located in the first key groove. The second flat key E3 is slidably connected to the first key groove.

Figure 13:
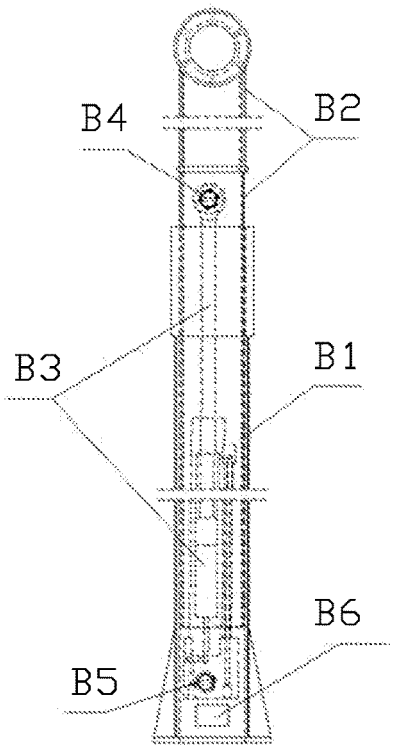
FIG. 13 is a structural schematic view of a height adjustment post.
Figure 14:
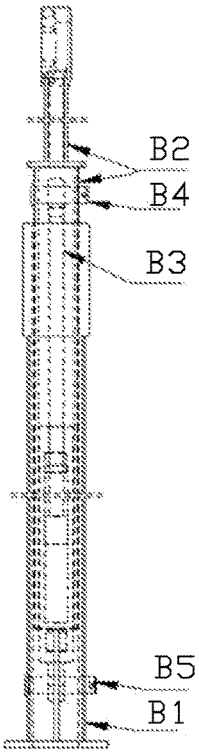
FIG. 14 is a side view of FIG. 13.

With reference to FIGS. 13 and 14, each of the height adjustment posts B includes a square inner sleeve B2, a square outer sleeve B1 and a height adjustment oil cylinder B3. A bottom portion of the square outer sleeve B1 is fixed on the continuous miner 7 via a bolt. One end of the square inner sleeve B2 is embedded in the square outer sleeve B1, and the square inner sleeve B2 is slidably connected to the square outer sleeve B1. A bottom portion of a cylinder body of the height adjustment oil cylinder B3 is hinged to the square outer sleeve B1 via a lower pin shaft B5. A top portion of the cylinder body of the height adjustment oil cylinder B3 extends into the square inner sleeve B2, and a piston rod of the height adjustment oil cylinder B3 is hinged to the square inner sleeve B2 via an upper pin shaft B4. A top portion of the square inner sleeve B2 is rotatably connected to the mesh rolling shaft C. The limit oil cylinder E4, the guide base E5 and the damping slide bar base D3 are all fixed on the square inner sleeve B2. The height adjustment oil cylinder B3 is a double-acting cylinder. A lower oil port of the height adjustment oil cylinder B3 extends out from a hole B6 at the bottom portion of the square outer sleeve B1 via a pipe, and is in communication with pressure oil. An upper oil port of the height adjustment oil cylinder B3 sequentially extends out from the holes B6 at a bottom portion of the square inner sleeve B2 and at the bottom portion of the square outer sleeve B1 via a pipe, and is in communication with pressure oil. The height adjustment oil cylinder B3 is driven by the separated disposed hydraulic system.

Figure 15:
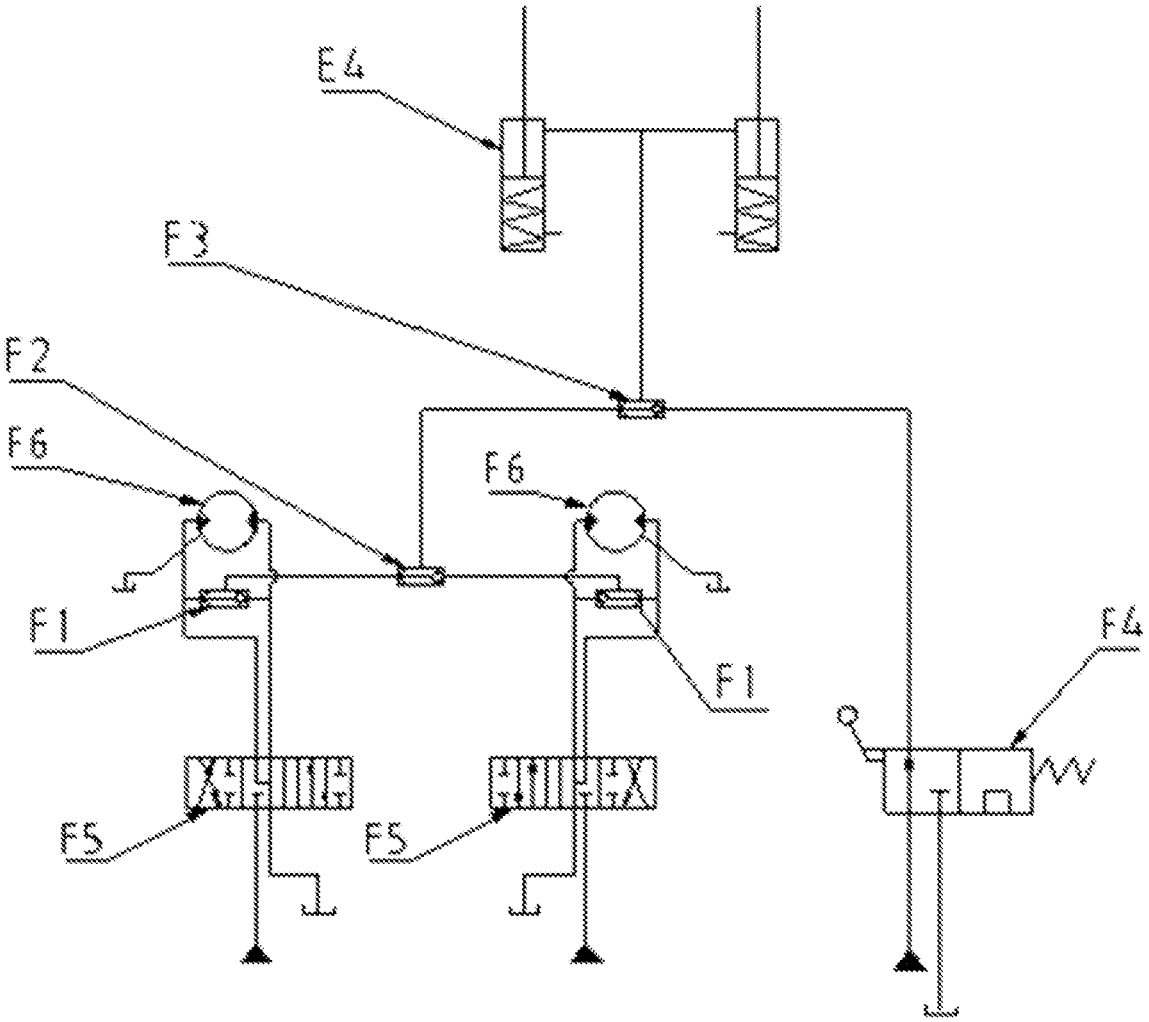
FIG. 15 is a schematic view of a hydraulic linkage principle of a limit oil cylinder and a travel mechanism of the continuous miner.

The limit oil cylinder E4 is a single-acting cylinder. An oil inlet of the limit oil cylinder E4 is in communication with the pressure oil via a travel reversing valve F5 of a travel mechanism on the continuous miner 7, so as to link the limit oil cylinder E4 to an oilway of a travel mechanism on the continuous miner 7. Specifically, with reference to FIG. 15, FIG. 15 illustrates a first shuttle valve F1, a second shuttle valve F2, a third shuttle valve F3, and a manual reversing valve F4. Two oil inlets of the first shuttle valve F1 are both connected to the travel reversing valve F5 on the continuous miner 7. The travel reversing valve F5 on the continuous miner 7 is connected to an oil return box and pressure oil. An oil outlet of the first shuttle valve F1 is connected to an oil inlet of the second shuttle valve F2. An oil outlet of the second shuttle valve F2 is connected to one oil inlet of the third shuttle valve F3. The other oil inlet of the third shuttle valve F3 is connected to an operating oil port of the manual reversing valve F4. The manual reversing valve F4 is a two-position three-way valve. An oil return port of the manual reversing valve F4 is connected to the oil return box. An oil inlet of the manual reversing valve F4 is connected to the pressure oil. An oil outlet of the third shuttle valve F3 is connected to the oil inlet of the limit oil cylinder E4. The two oil inlets of the first shuttle valve F1 are respectively connected to a hydraulic travel motor F6 on the continuous miner 7 in parallel. The first shuttle valves F1, the travel reversing valves F5, and the hydraulic travel motors F6 are all two. The travel mechanism of on the existing continuous miner 7 generally includes a hydraulic travel motor F6 and a travel reversing valve F5. The limit oil cylinder E4 is linked to the travel mechanism of the continuous miner. When the continuous miner displaces, the limit piston rod E41 of the limit oil cylinder E4 retracts, and drives the limit slide bar E2 to draw out from the groove of the limit gear E1 and release the limit to the mesh rolling shaft C. When the continuous miner does not travel, the limit oil cylinder E4 extends out the limit piston rod E41 under the drive of a reset spring E43, so as to push the limit slide bar E2 into the tooth space of the limit gear E1, thereby limiting and locking the mesh rolling shaft C.

The operating principle of the limit oil cylinder E4 is as follows. When the travel mechanism of the continuous miner travels, the actions of the travel reversing valve F5 are to supply oil to the hydraulic travel motor F6 and simultaneously output the pressure oil to the first shuttle valve F1. The pressure oil is then enters the limit oil inlet E42 of the limit oil cylinder E4 via the second shuttle valve F2 and the third shuttle valve F3, so as to release the limit to the mesh rolling shaft C. if the limit to the mesh rolling shaft C needs to be released when the continuous miner does not travel, then hydraulic oil can be supplied to the limit oil inlet E41 of the limit oil cylinder E4 via the manual reversing valve F4, such that the purpose of releasing the limit to the mesh rolling shaft can also be achieved. When the manual reversing valve F4 does not need to manually release locking, the manual reversing valve F4 switch the pressure oil to the oil return box for loading off. When the manual reversing valve needs to manually release locking, a handle of the manual reversing valve F4 is operated to reverse the valve and switch the pressure oil to the third shuttle valve F3. The pressure oil enters the limit oil cylinder E4 via the third shuttle valve F3, and drives the limit oil cylinder E4 to release locking.

The operating principle of the limit mechanism E is as follow. With reference to FIG. 6 and FIG. 7, the limit oil cylinder E4 in the limit mechanism E includes a limit cylinder body E44, a limit piston rod E41, a limit oil inlet E42, a breathing hole E45, and a reset spring E43. The limit oil cylinder E4 is a single-acting cylinder. When the continuous miner does not travel, the limit oil inlet E42 bears no pressure, the reset spring E53 pushes a piston rod (namely the limit piston rod E41) of the single-acting cylinder, the limit piston rod E41 then pushes the limit slide bar E2 to extend out, a tip of the limit slide bar E2 is inserted in the tooth space of the limit gear E1, so as to get stuck the limit gear E1 and then get stuck the entire mesh rolling shaft C1. The mesh hanging disk C4 hooks the flexible mesh 4, the mesh roll C41 cannot continuously be unfolded, the back unfolded mesh C42 is tightened, and a worker performs the roof support work under the tightened mesh. When the continuous miner travels, the hydraulic system supplies the pressure oil to the limit oil inlet E42, the pressure oil compresses the reset spring E43, drives the limit piston rod E41 of the limit oil cylinder E4 and then drives the limit slide bar E2 to retract. The limit slide bar E2 slides out from the tooth space of the limit gear E1, releases the limit to the limit gear E1, and then releases the limit to the mesh rolling shaft C. The unfolded mesh C42 is already fixed on the tunnel roof by a bolt support system. Therefore, when the continuous miner travels forward, the mesh rolling shaft C passively rotates under the traction of the unfolded mesh C42. The mesh roll 41 is automatically unfolded to be the unfolded mesh C42. The process can be completed by the linked hydraulic system without manual intervention. The mesh roll 41 can be directly placed on the mesh roll storage rack A. Alternatively, a rotary shaft can be mounted on the mesh roll storage rack A, and the mesh roll 41 can be wound and fixed on the rotary shaft, as long as the gravity or a tensile force of the mesh roll 41 can tighten the unfolded mesh C42. The operating principle of the damping mechanism D is as follows. The adjustment screw plug D5 presses the damping spring D2, and the damping spring D2 pushes the damping slide bar D1 to extend out. The head of the damping slide bar D1 is embedded in the damping disk cover D4. When the mesh rolling shaft C needs to rotate, only a big enough traction force is provided, can the resistance of the damping slide bar D1 be overcome and the damping slide bar D1 be pressed back. With the method, the mesh rolling shaft C is prevented from automatically backward rotating which leads to excessive unfolding of the mesh roll 41 and loosing of the unfolded mesh 42.

What is claimed is:

1. An apparatus for controllably unfolding a flexible mesh for a continuous miner, the apparatus comprising a mesh roll storage rack, a height adjustment post, a mesh rolling shaft and a flexible mesh, wherein the flexible mesh includes a mesh roll and an unfolded mesh; the mesh roll and the unfolded mesh are an integrated structure; the mesh roll is located on the mesh roll storage rack; the unfolded mesh is clamped on the mesh rolling shaft, and is pressed on a cut and un-supported tunnel roof via a roof bolt; the mesh rolling shaft is rotatably connected to a top portion of the height adjustment post; the mesh roll storage rack and the height adjustment post are both mounted on the continuous miner; the mesh rolling shaft is located at a back end of the mesh roll storage rack;

a plurality of mesh hanging disks are fixed on an outer surface of the mesh rolling shaft; the unfolded mesh is clamped on the mesh hanging disks; a limit mechanism and a damping mechanism are disposed on the mesh rolling shaft; the limit mechanism comprises a limit oil cylinder, a limit slide bar and a limit gear; a limit cylinder body of the limit oil cylinder is fixedly connected to the height adjustment post; a limit piston rod of the limit oil cylinder is hinged to a bottom portion of the limit slide bar; the limit gear is fixed on the mesh rolling shaft, and is located above the limit slide bar; the limit oil cylinder is used to drive the limit slide bar to engage with a tooth space of the limit gear fixed to the mesh rolling shaft, so as to limit the mesh rolling shaft; the damping mechanism comprises a damping slide bar, a damping spring, a damping slide bar base, a damping disk cover and an adjustment screw plug; the damping slide bar base is internally provided with a penetrative cavity extending in a length direction thereof; the adjustment screw plug is threadedly connected to a tail of the cavity in the damping slide bar base; a bottom end of the damping slide bar extends into the cavity from a top portion of the damping slide bar base; the damping spring is located in the cavity; a top portion of the damping spring is in contact with the bottom end of the damping slide bar, and a bottom portion of the damping spring is in contact with a top portion of the adjustment screw plug; the damping disk cover is fixed on the mesh rolling shaft; an outer surface of the damping disk cover is provided with a plurality of arc-shaped notches distributed in a circumferential direction thereof, and the arc-shaped notches are located above the damping slide bar; and the damping spring is used to press the damping slide bar into the arc-shaped notches of the damping disk cover, so as to damp the mesh rolling shaft.

2. The apparatus for controllably unfolding a flexible mesh for a continuous miner according to claim 1, wherein the mesh rolling shaft comprises an intermediate portion, a first side portion and a second side portion; the uniformly distributed mesh hanging disks are fixed on outer surfaces of the intermediate portion, the first side portion and the second side portion; two ends of the intermediate portion are both provided with a first connecting shaft and a second connecting shaft which are connected to each other; the intermediate portion, the first connecting shaft and the second connecting shaft are an integrated structure, and diameters thereof progressively decrease; the intermediate portion, the first connecting shaft and the second connecting shaft are sequentially connected; one end portion of the first side portion and one end portion of the second side portion are both provided with a shaft hole cooperatively connected to the second connecting shaft; the second connecting shaft at one end of the intermediate portion extends into the shaft hole of the first side portion, and the second connecting shaft is connected to the shaft hole of the first side portion via a first flat key; the second connecting shaft at the other end of the intermediate portion extends into the shaft hole of the second side portion, and the second connecting shaft is connected to the shaft hole of the second side portion via a first flat key.

3. The apparatus for controllably unfolding a flexible mesh for a continuous miner according to claim 2, wherein a number of the height adjustment post is two; the top portion of one of the height adjustment posts is rotatably connected to the second connecting shaft at one end of the intermediate portion via a rolling bearing which is located at one end of the second connecting shaft connected to the first connecting shaft; the top portion of the other one of the height adjustment posts is rotatably connected to the second connecting shaft at the other end of the intermediate portion via a rolling bearing which is located at one end of the second connecting shaft connected to the first connecting shaft; an outer ring of the rolling bearing is in interference connection with the top portion of the height adjustment posts; and an inner ring of the rolling bearing is in interference connection with the second connecting shaft.

4. The apparatus for controllably unfolding a flexible mesh for a continuous miner according to claim 3, wherein a number of the limit mechanism and a number of the damping mechanism are both two; the limit gear in one of the limit mechanisms is fixedly connected to one end surface of the intermediate portion via a screw, and the limit gear is sleeved on the first connecting shaft connected to the end surface; the limit gear in the other one of the limit mechanisms is fixedly connected to the other end surface of the intermediate portion via a screw, and the limit gear is sleeved on the first connecting shaft connected to the end surface; the damping disk cover in one of the damping mechanisms is fixedly connected, via a screw, to an end surface of the first side portion provided with the shaft hole, and the damping disk cover is sleeved on the second connecting shaft connected to the shaft hole; the damping disk cover in the other one of the damping mechanisms is fixedly connected, via a screw, to an end surface of the second side portion provided with the shaft hole, and the damping disk cover is sleeved on the second connecting shaft connected to the shaft hole.

5. The apparatus for controllably unfolding a flexible mesh for a continuous miner according to claim 4, wherein an annular clamping groove is respectively disposed on outer surfaces of the second connecting shafts at the two ends of the intermediate portion; two semi-circular clamping keys are clamped in the annular clamping groove, and the two semi-circular clamping keys are fitted together to form a circular clamping key; an end surface of the semi-circular clamping key on the outer surface of the second connecting shaft at one end of the intermediate portion is in close contact with one end surface of the first side portion; an end surface of the semi-circular clamping key on the outer surface of the second connecting shaft at the other end of the intermediate portion is in close contact with one end surface of the second side portion; the damping disk cover comprises a damping portion and a disk cover portion; the damping portion and the disk cover portion are connected to each other, and are an integrated structure; an outer surface of the damping portion is provided with a plurality of arc-shaped notches distributed in a circumferential direction thereof; a plurality of fixing holes are disposed on an outer surface of the disk cover portion; a circular groove for placing the semi-circular clamping keys is disposed on an inner wall of the disk cover portion; the disk cover portion in one damping disk cover is fixedly connected to one end surface of the first side portion via the fixing holes, and the groove on the inner wall of the disk cover portion and one annular clamping groove are in a same vertical direction; the disk cover portion in the other damping disk cover is fixedly connected to one end surface of the second side portion via the fixing holes, and the groove on the inner wall of the disk cover portion and the other annular clamping groove are in a same vertical direction; and the semi-circular clamping key is located between the annular clamping groove and the groove on the inner wall of the disk cover portion.

6. The apparatus for controllably unfolding a flexible mesh for a continuous miner according to claim 4, wherein each of the limit mechanisms further comprises a guide base; the guide base is located above the limit oil cylinder; the guide base is fixedly connected to a respective one of the height adjustment posts; the guide base is internally provided with a penetrative strip-shaped chamber extending in a length direction thereof; the limit slide bar penetrates through the strip-shaped chamber in the guide base; a first key groove is disposed on an inner wall of the strip-shaped chamber; a second key groove matched with the first key groove is disposed on an outer surface of the limit slide bar; a second flat key is fixed in the second key groove, and the second flat key is located in the first key groove; and the second flat key is slidably connected to the first key groove.

7. The apparatus for controllably unfolding a flexible mesh for a continuous miner according to claim 1, wherein an outer surface of the mesh hanging disk is provided with a plurality of inclined mesh hanging grooves distributed in a circumferential direction thereof; the unfolded mesh is clamped in the mesh hanging grooves; the mesh hanging disk is fixedly connected to the mesh rolling shaft by welding; the mesh roll storage rack comprises a rack body and a plurality of support rollers arranged in an arc shape along the rack body; the support roller comprises a support roller shaft (Al2) and a support roller sleeve; two ends of the support roller shaft are fixedly connected to the rack body; the support roller sleeve is sleeved outside the support roller shaft, and is rotatably connected to the support roller shaft; the mesh roll is located on the support roller; and the rack body is mounted on the continuous miner.

8. The apparatus for controllably unfolding a flexible mesh for a continuous miner according to claim 1, wherein the height adjustment post comprises a square inner sleeve, a square outer sleeve and a height adjustment oil cylinder; a bottom portion of the square outer sleeve is fixed on the continuous miner via a bolt; one end of the square inner sleeve is embedded in the square outer sleeve, and the square inner sleeve is slidably connected to the square outer sleeve; a bottom portion of a cylinder body of the height adjustment oil cylinder is hinged to the square outer sleeve via a lower pin shaft; a top portion of the cylinder body of the height adjustment oil cylinder extends into the square inner sleeve, and a piston rod of the height adjustment oil cylinder is hinged to the square inner sleeve via an upper pin shaft; a top portion of the square inner sleeve is rotatably connected to the mesh rolling shaft; the limit oil cylinder, the guide base and the damping slide bar base are all fixed on the square inner sleeve; the height adjustment oil cylinder is a double-acting cylinder; a lower oil port of the height adjustment oil cylinder extends out from a hole at the bottom portion of the square outer sleeve via a pipe, and is in communication with pressure oil; an upper oil port of the height adjustment oil cylinder sequentially extends out from the holes at a bottom portion of the square inner sleeve and at the bottom portion of the square outer sleeve via a pipe, and is in communication with pressure oil.

9. The apparatus for controllably unfolding a flexible mesh for a continuous miner according to claim 1, wherein the limit oil cylinder is a single-acting cylinder; an oil inlet of the limit oil cylinder is in communication with the pressure oil via a travel reversing valve on the continuous miner, so as to link the limit oil cylinder to an oilway of a travel mechanism on the continuous miner.

10. A continuous miner, comprising the apparatus for controllably unfolding a flexible mesh for a continuous miner as claimed in claim 1.

* * * * *